US009408451B2

(12) United States Patent
Tsai

(10) Patent No.: US 9,408,451 B2
(45) Date of Patent: Aug. 9, 2016

(54) ADJUSTABLE HAIR FASTENER

(71) Applicant: Kai-Mou Tsai, Taipei (TW)

(72) Inventor: Kai-Mou Tsai, Taipei (TW)

( * ) Notice: Subject to any disclaimer, the term of this patent is extended or adjusted under 35 U.S.C. 154(b) by 0 days.

(21) Appl. No.: 14/562,877

(22) Filed: Dec. 8, 2014

(65) Prior Publication Data

US 2016/0157577 A1 Jun. 9, 2016

(51) Int. Cl.

| | |
|---|---|
| ***A45D 8/12*** | (2006.01) |
| ***A45D 8/34*** | (2006.01) |
| ***A45D 8/36*** | (2006.01) |
| *A41D 20/00* | (2006.01) |
| *A45D 8/00* | (2006.01) |

(52) U.S. Cl.
CPC .. *A45D 8/34* (2013.01); *A45D 8/36* (2013.01); *A41D 20/00* (2013.01); *A45D 8/00* (2013.01)

(58) Field of Classification Search
CPC ..... A45D 8/00; A45D 8/34; A45D 8/36; A45D 2008/002; A45D 2008/004; A45D 2008/006; A41D 23/00; A41D 20/00; A42B 1/041; A42B 10/004; A42B 1/24
See application file for complete search history.

(56) References Cited

U.S. PATENT DOCUMENTS

| | | | | | |
|---|---|---|---|---|---|
| 4,723,325 | A * | 2/1988 | Perry | A41D 20/00 | 2/181 |
| 4,760,715 | A * | 8/1988 | Ramos, Jr. | 63/5.2 | |
| 5,379,782 | A * | 1/1995 | Tabb | A45D 8/00 | 132/273 |
| 5,590,422 | A * | 1/1997 | Henderson | 2/171 | |
| D395,139 | S * | 6/1998 | Lee | D28/41 | |
| 6,076,532 | A * | 6/2000 | Thomas | A45D 8/36 | 132/273 |
| D475,804 | S * | 6/2003 | Stachowski | D28/41 | |
| D695,995 | S * | 12/2013 | Kim | D2/500 | |
| 2006/0157077 | A1* | 7/2006 | Kraft | A45D 8/34 | 132/200 |
| 2010/0252064 | A1* | 10/2010 | Shyu | 132/273 | |
| 2012/0174942 | A1* | 7/2012 | Carey | 132/273 | |
| 2013/0340787 | A1* | 12/2013 | Genzlinger | A45D 8/36 | 132/273 |

* cited by examiner

*Primary Examiner* — Robyn Doan
(74) *Attorney, Agent, or Firm* — Rosenberg, Klein & Lee

(57) ABSTRACT

An adjustable hair fastener includes a first elastic band formed of an elastic cord, and a second elastic band formed of an elastic cord longer than the elastic cord of the first elastic band and wound round the elastic cord of the first elastic band.

3 Claims, 4 Drawing Sheets

ADJUSTABLE HAIR FASTENER

BACKGROUND OF THE INVENTION

1. Field of the Invention

The present invention relates to hair fastening devices and more particularly, to an adjustable hair fastener that can be conveniently adjusted for different hair fastening applications.

2. Description of the Related Art

U.S. Pat. No. 5,758,671 and 6,000,408 disclose a hair fastener design that comprises an annular, flexible sleeve of cloth having a circumference of predetermined length, opposed inside and outside walls, and opposite side edges; means forming an annular pocket in the sleeve intermediate said side edges; and annular elastic means positioned in the pocket so that it has an unstressed contracted condition. Thus, the hair fastener can be used for wrapping up the horse tail hair, or fastened to the wrist or leg as an ornament. The aforesaid prior art hair fastener can simply be used for wrapping up the hair, having a limited application range.

SUMMARY OF THE INVENTION

The present invention has been accomplished under the circumstances in view. It is one object of the present invention to provide an adjustable hair fastener, which can be conveniently adjusted for different hair fastening applications.

To achieve this and other objects of the present invention, an adjustable hair fastener of the invention.

An adjustable hair fastener includes a first elastic band formed of an elastic cord, and a second elastic band formed of an elastic cord longer than the elastic cord of the first elastic band and wound round the elastic cord of the first elastic band.

Thus, the relatively shorter elastic cord of the first elastic band can be used for wrapping up the horse tail hair. Further, the adjustable hair fastener can be adjusted for use as a hair bandage by: extending out the elastic cord of the second elastic band and pushing the first elastic band toward one end of the second elastic band.

DETAILED DESCRIPTION OF THE PREFERRED EMBODIMENT

Figure 1:
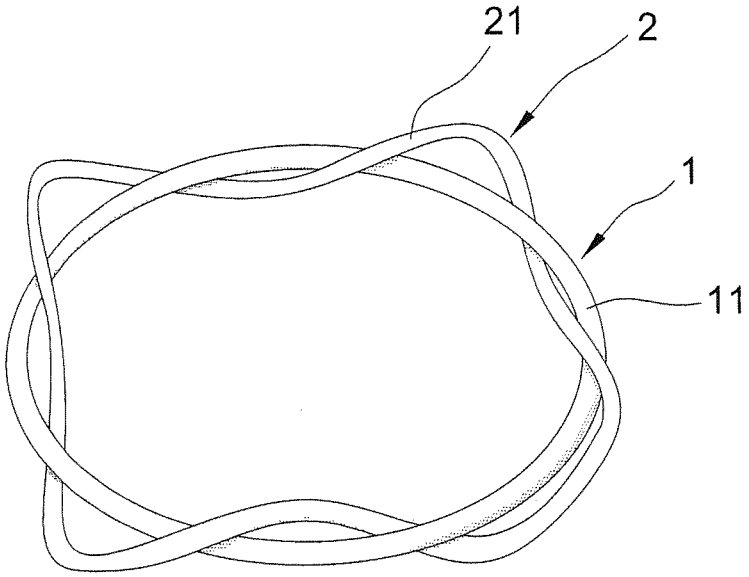
FIG. 1 illustrates an adjustable hair fastener in accordance with a first embodiment of the present invention.
Figure 2:
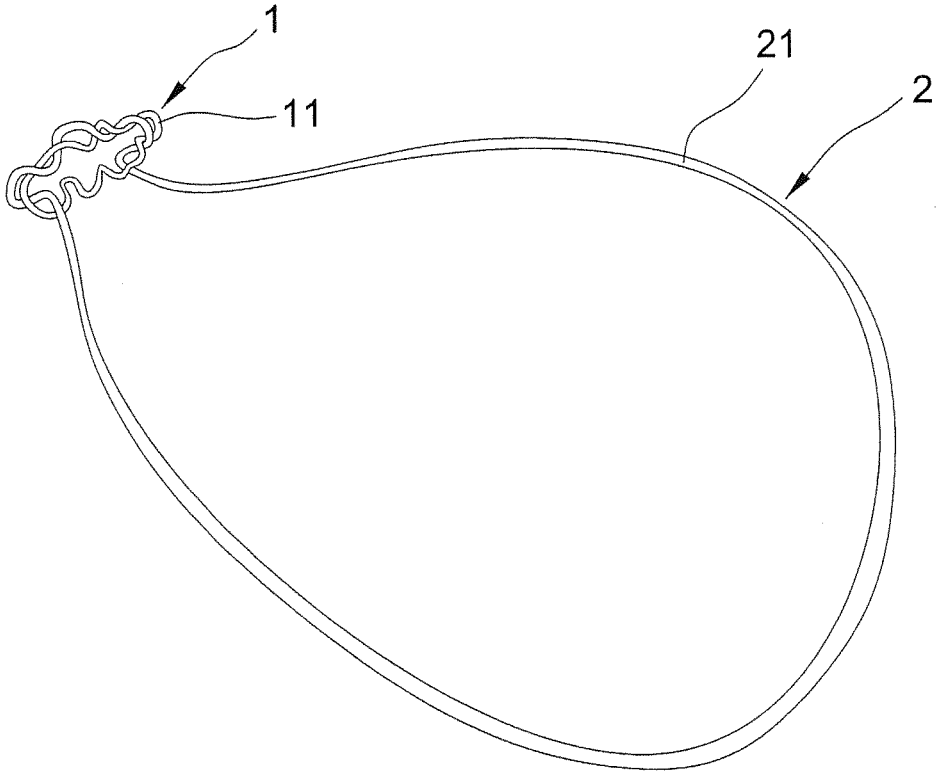
FIG. 2 illustrates the adjustable hair fastener of the first embodiment of the present invention adjusted for use as a hair bandage.
Figure 3:
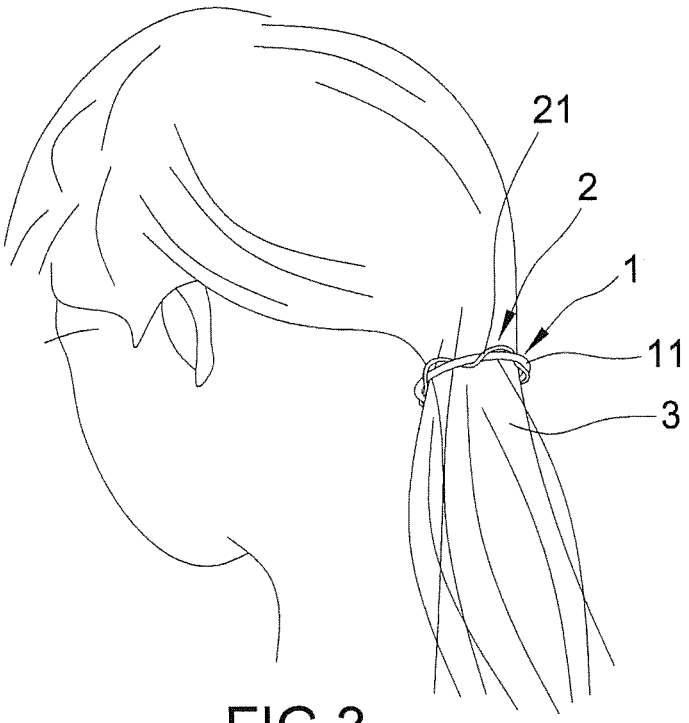
FIG. 3 illustrates an application example of the adjustable hair fastener of the first embodiment of the present invention.
Figure 4:
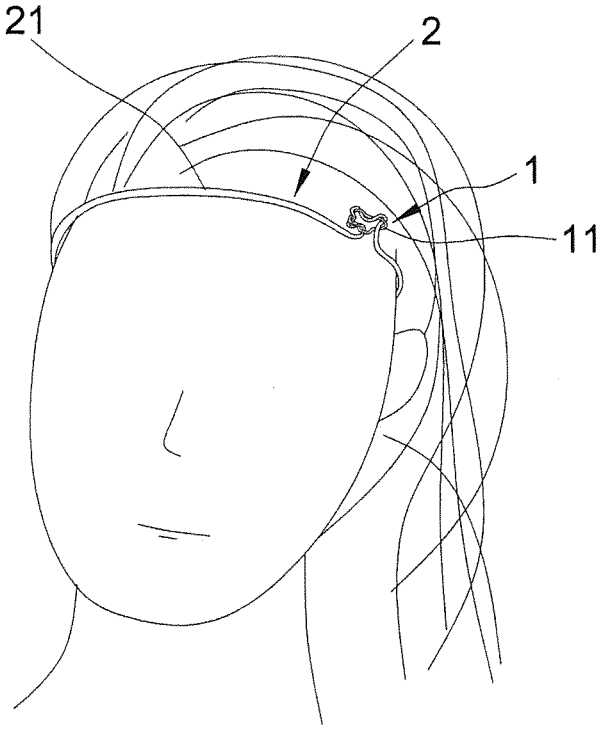
FIG. 4 illustrates another application example of the adjustable hair fastener of the first embodiment of the present invention.

Referring to FIGS. 1-4, an adjustable hair fastener in accordance with a first embodiment of the present invention is shown. The adjustable hair fastener comprises a first elastic band (1) and a second elastic band (2). The first elastic band (1) is formed of an elastic cord (11). The second elastic band (2) is formed of an elastic cord (21) that is longer than the elastic cord (11) of the first elastic band (1). The elastic cord (21) of the second elastic band (2) is regularly wound round the elastic cord (11) of the first elastic band (1), and thus the first elastic band (1) and the second elastic band (2) joined together. In application, the relatively shorter elastic cord (11) of the first elastic band (1) can be used for wrapping up the horse tail hair (3) (see FIG. 3). Further, the adjustable hair fastener can be adjusted for use as a hair bandage by: extending out the elastic cord (21) of the second elastic band (2) and pushing the first elastic band (1) toward one end of the second elastic band (2) (see FIG. 2), and thus, the second elastic band (2) can be used as a hair bandage (see FIG. 4).

Figure 5:
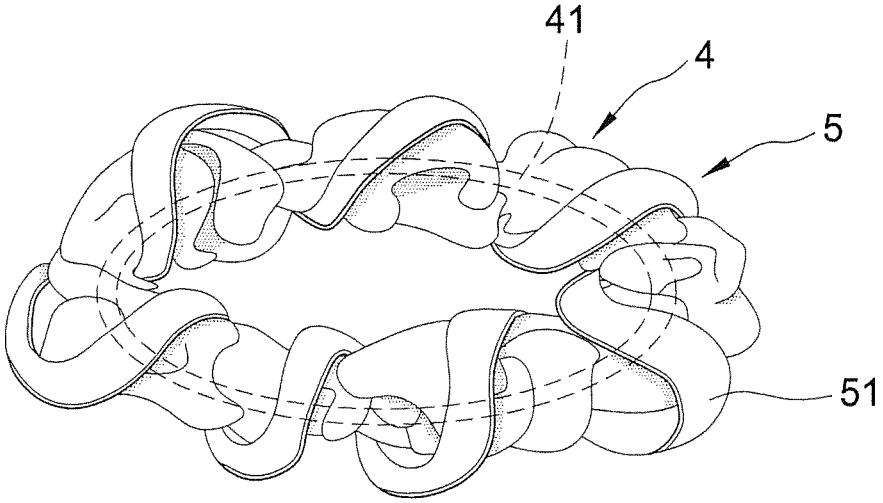
FIG. 5 illustrates an adjustable hair fastener in accordance with a second embodiment of the present invention.
Figure 6:
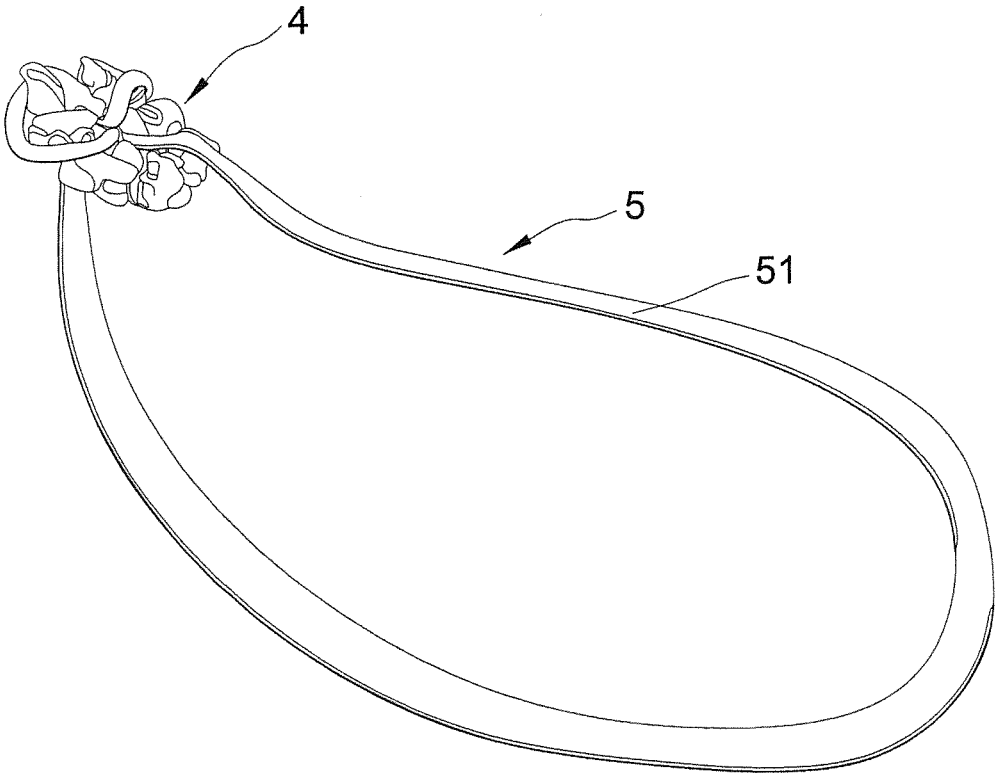
FIG. 6 illustrates the adjustable hair fastener of the second embodiment of the present invention adjusted for use as a hair bandage.

Referring to FIGS. 5 and 6, an adjustable hair fastener in accordance with a second embodiment of the present invention is shown. The adjustable hair fastener comprises a collapsible loop-like fabric ornamental layer (4) made of an elastic cloth by stitching, an elastic cord (41) mounted in the collapsible loop-like fabric ornamental layer (4), and an elastic band (5) formed of an elastic cord (51) and wound around the collapsible loop-like fabric ornamental layer (4). The elastic band (5) has a circumference of predetermined length longer than the collapsible loop-like fabric ornamental layer (4). Subject to the elasticity of the elastic cord (41) in the collapsible loop-like fabric ornamental layer (4), the collapsible loop-like fabric ornamental layer (4) can be used to wrap up the horse tail hair (3). Further, the collapsible loop-like fabric ornamental layer (4) can be pushed in one direction relative to the elastic band (5) and received at one end of the elastic band (5) to work as an ornament (see FIG. 6), allowing the elastic band (5) to be used as a hair bandage like the application example shown in FIG. 4.

Figure 7:
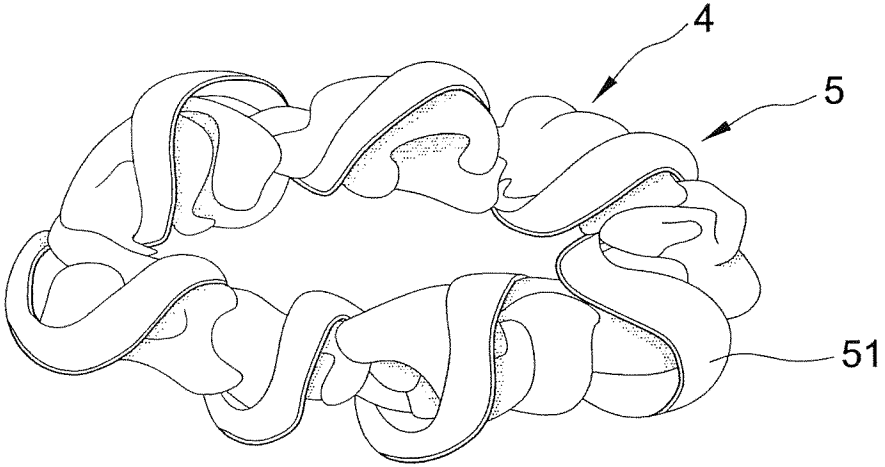
FIG. 7 illustrates an adjustable hair fastener in accordance with a third embodiment of the present invention.

Referring to FIG. 7, an adjustable hair fastener in accordance with a third embodiment of the present invention is shown. This third embodiment is substantially similar to the aforesaid second embodiment with the exception that this third embodiment eliminates the aforesaid elastic cord (41).

Further, the aforesaid elastic bands (1)(2)(5) and collapsible loop-like fabric ornamental layer (4) can be made in any of a variety of colors, or configured to provide a particular color design. Further, the elastic cords (11)(21)(51) can be elastic wire cords or elastic cloth strips.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An adjustable hair fastener comprising:

a first elastic loop formed of an elastic cord, and a second elastic loop formed of an elastic cord longer than the first elastic loop; the second elastic loop including a front non interwoven portion and a rear interwoven portion wherein the non interwoven portion and the interwoven portion intersect at opposing first and second intersections, and wherein said rear interwoven portion of the second elastic loop is interwoven in a non detachable manner with a majority portion of the first elastic loop such that a narrow gap exists between the opposing first and second intersections of the second elastic loop and the non interwoven portion of the first elastic loop is dispose within and extends transversely across the gap; said first and second elastic loops being independently and elastically displaceable with each other and when the device is in a use position, said second elastic loop is configured to encircle a user's head while said first elastic loop is configured to hold a ponytail of the user.

2. The adjustable hair fastener as claimed in claim 1, wherein said first elastic band and said second elastic band have different colors.

3. The adjustable hair fastener as claimed in claim 1, wherein the elastic cords of said first elastic band and said second elastic band are selectively made of an elastic wire cord or elastic cloth strip.

* * * * *